US007059411B2

(12) United States Patent
Hayes

(10) Patent No.: US 7,059,411 B2
(45) Date of Patent: Jun. 13, 2006

(54) PROCESS OF USING A PROPELLANT TREATMENT AND CONTINUOUS FOAM REMOVAL OF WELL DEBRIS AND APPARATUS THEREFORE

(75) Inventor: Kirby Hayes, Lloydminster (CA)

(73) Assignees: Kirby Hayes Incorporated, Lloydminster (CA); Hurricane Industries LTD, Lloydminster (CA)

( * ) Notice: Subject to any disclaimer, the term of this patent is extended or adjusted under 35 U.S.C. 154(b) by 23 days.

(21) Appl. No.: 10/694,858

(22) Filed: Oct. 29, 2003

(65) Prior Publication Data

US 2005/0045334 A1 Mar. 3, 2005

Related U.S. Application Data

(63) Continuation-in-part of application No. 10/650,709, filed on Aug. 29, 2003, now abandoned.

(51) Int. Cl.
*E21B 29/02* (2006.01)
*E21B 37/00* (2006.01)

(52) U.S. Cl. ..... 166/298; 166/55.1; 166/299; 166/311

(58) Field of Classification Search ..... 166/311, 166/308.6, 297, 298, 55.1, 299
See application file for complete search history.

(56) References Cited

U.S. PATENT DOCUMENTS 3,559,739 A * 2/1971 Hutchison ..... 166/311
4,617,997 A 10/1986 Jennings, Jr.
4,633,951 A 1/1987 Hill et al.
4,823,875 A 4/1989 Hill et al.
5,363,917 A 11/1994 Jennings et al.
5,441,110 A * 8/1995 Scott, III ..... 166/308.1
5,775,426 A 7/1998 Snider et al.
5,865,254 A * 2/1999 Huber et al. ..... 166/373
5,888,021 A * 3/1999 Kawabata ..... 166/246
6,138,753 A 10/2000 Mohaupt
6,173,783 B1 * 1/2001 Abbott-Brown et al. .... 166/370
6,336,506 B1 * 1/2002 Wesson ..... 166/308.1
6,494,261 B1 12/2002 Pahmiyer
2001/0004937 A1 * 6/2001 Leniek ..... 166/369

OTHER PUBLICATIONS http://www.rocanda.com/, 2 pages, Aug. 7, 2003.
http://www.rocanda.com/products/tcr1.htm, 2 pages, Aug. 7, 2003.
http://www.rocanda.com/products/tg2.htm, 1 page, Aug. 7, 2003.
Owen Oil Tools Division website, 2 pages, Aug. 7, 2003.
http://www.glossary.oilfield.slb.com/Display.cfm?Term=tubing%2Dconveyed%20perforating, 1 page, Aug. 7, 2003.

(Continued)

*Primary Examiner*—George Suchfield
(74) *Attorney, Agent, or Firm*—Sean W. Goodwin

(57) ABSTRACT

A damaged formation is stimulated by igniting a propellant adjacent openings in the wellbore in communication with the damaged formation. Substantially immediately thereafter, low density foam is injected adjacent the openings and circulated to the surface for the removal of debris released from the formation. A tubing string has a foam discharge port at a distal end and a foam injection port at surface. The tubing string extends sufficiently above the wellbore at surface to enable lowering of the tubing string and foam discharge port to below the openings for enhanced removal of debris.

26 Claims, 6 Drawing Sheets

OTHER PUBLICATIONS www.west.net/~sevodyn/SVCS_inf.htm, 1 page, Aug. 7, 2003.
http://www.bakerhughes.com/bakeratlas/completion/perforating_advanced.htm, 2 pages, Aug. 11, 2003.
http://www.bakerhughes.com/bakerpetrolite/oilgas/foam/products.htm, 2 pages, Aug. 7, 2003.
http://www.bakerhughes.com/bakerpetrolite/oilgas/foam/, 1 page, Aug. 7, 2003.
http://www.bakerhughes.com/bakerpetrolite/oilgas/foam/about.htm, 1 page, Aug. 7, 2003.
http://www.thegasgun.com/Technolgoy.htm, 2 pages, Aug. 7, 2003.
http://www.logwell.com/tech/shot/propellant_shot.html, 3 pages, Aug. 7, 2003.
http://www.propelltech.com/solution.html, 1 page, Aug. 13, 2003.
http://www.kirbyhayes.com/stablefoam.htm, 2 pages, Jan. 15, 2003.
http://www.lloydminsterheavyoil.com/CPperforate.htm, 5 pages, Dec. 20, 2002.
http://www.kirbyhayes.com/perfwhilefoam.htm, 2 pages, Dec. 20, 2002.
1998 SPE European Petroleum Conference, The Hague, The Netherlands, Oct. 20-22, 1998, *Innovative Live Well Perforating System Used in the Stratford Field*, Kleppa et al., copyright 1998, Society of Petroleum Engineers, SPE 50588, 10 pages.

* cited by examiner 3a
3b
3c
3d
3e
3f
3g
3h
10
12
13
16
16,26
19
20
22
23
24
26
28,29
29
30
40
43
45
46
47
50
51

PROCESS OF USING A PROPELLANT TREATMENT AND CONTINUOUS FOAM REMOVAL OF WELL DEBRIS AND APPARATUS THEREFORE

CROSS REFERENCE TO RELATED APPLICATION

This application is a continuation-in-part of U.S. patent application Ser. No. 10/650,709 filed on Aug. 29, 2003, now abandoned the entirety of which is incorporated herein by reference.

FIELD OF THE INVENTION

This invention relates to a method and apparatus to stimulate a well through ignition of a propellant in a well adjacent openings such as perforations and then to immediately thereafter circulate foam for removing blockage material from an underground formation.

BACKGROUND OF THE INVENTION

The primary bottlenecks to the production of hydrocarbons from a well is the inflow rate from the hydrocarbon formation into the wellbore. The inflow is affected by near wellbore condition and formation characteristics. The near wellbore conditions and the formations of damaged wells can be positively influenced, with increased hydrocarbon production, through stimulation treatment. Methods for well stimulation include, but are not limited to, treatments with various chemicals, hydraulic fracturing where liquids are injected under high pressure (usually with propping agents), methods in which explosives are detonated within the formations to effect mechanical fracture, and combinations of the above procedures.

Oil and gas wells are subject to many ailments, some of which are treatable. One such ailment is a blockage of perforations resulting in dramatic or catastrophic decline in production. Some formations, such as an unconsolidated formation contain fines, such as sand, which flow into the perforation and become trapped, creating a plug or blockage in the perforation. Other examples of blockages, or bridging, are perforation debris, clays, silts, asphaltenes, drilling damage, and foreign or manmade objects. It is therefore desirable to remove these blockages from the perforations.

One such method is described in U.S. Pat. No. 4,617,997 to Jennings, Jr. which teaches a method to create or enhance fractures in a formation and extending these fractures with foam generated downhole. A foaming agent is mixed with an aqueous fluid and placed into the wellbore fluid, the level of the wellbore fluid being above the perforations and productive interval of the formation. A propellant housed in a canister, which is attached to a retrievable wire line, is placed next to the fractures. The propellant is ignited creating heat, gas and pressure while simultaneously initiating the formation of foam. The foam enters the fractures under such increased pressure for extending the radial fractures. When the pressure decreases and the foam collapses, the decreased viscosity of the wellbore fluid causes any resultant fluid and debris which has accumulated in the fractures to return into the wellbore. It is not disclosed if or how resulting accumulated and recovered debris is removed from the wellbore.

Another method is taught by Mohaupt in U.S. Pat. No. 6,138,753. Mohaupt teaches a technique for treating hydrocarbon wells, using two separate propellant ignition phases.

A gas generator comprising a propellant charge, housed in a carrier having many openings, is lowered into the well in-line with the perforated interval. The gas generator is ignited and produces sufficient energy to breakdown and clean-out all of the perforations and create micro-fractures originating from the perforations. This is followed by igniting a second gas generator to inject a treatment liquid into the formation with energy less than that required to fracture the formation. No removal of resulting debris is contemplated.

A technique to both remove blockage mechanisms, debris and fines from perforations and to ensure the complete removal of this debris from the wellbore is needed. Although blockage removal from perforations or fractures is a by-product of some fracturing procedures, the method and results vary. Jennings Jr. uses the foam primarily for a different purpose, to extend the fractures and is limited to the amount of foam produced by the foaming agent. Mohaupt breaks down debris and cleans-out perforations but does not remove the debris from the well. Mohaupt also does not use foaming techniques. If blockage debris and fines are not completely removed from the wellbore, the remaining debris can re-block perforations, erode production equipment and seals, or plug the outside or the inside of the production tubing reducing or totally restricting production. Well clean-out procedures would be repeatedly required at a large expense.

SUMMARY OF THE INVENTION

A process is described for formation treatment or stimulation and which accommodates clean-up of debris associated with the stimulation. In one embodiment, a propellant is ignited adjacent openings to the formation and, substantially immediately thereafter, foam is continuously injected adjacent the openings and circulated up through a wellbore to remove debris from the formation and convey the debris therefrom. The tubing string extends sufficiently above the wellbore at surface to enable lowering of the tubing string and foam discharge port to below the openings for enhanced removal of debris.

In a broad aspect, a process for treating a wellbore having openings in communication with a damaged formation comprises: running in a tubing string into the wellbore to position a propellant carrier adjacent the openings; overbalancing the wellbore to establish hydrostatic pressure on the formation; igniting the propellant so as to produce a pressure event and a volume of gas directed into the formation; injecting low density foam through the tubing string and into the wellbore at a location above the propellant carrier so as to reduce the hydrostatic pressure and produce at least some debris from the formation and into the wellbore; and conveying the debris from the wellbore by circulating the foam out of the wellbore at surface until sufficient debris is removed. Typically thereafter the tubing string is then removed. It is preferable to lower the tubing string during foam circulation so as to re-position the location of foam injection below the openings In another broad aspect, novel apparatus for achieving this process comprises: a tubing string in the casing and extending downhole from surface for positioning a propellant in a propellant carrier adjacent the openings and forming an annulus between the tubing string and the casing; means for igniting the propellant; and means, such as a foam discharge port in the tubing string adjacent and above the propellant, for injecting and circulating foam from an injection location adjacent the openings, up the annulus and out of the wellbore. More preferably, the tubing string extends sufficiently above surface to enable lowering the foam discharge port below the openings for enhanced debris recovery.

DETAILED DESCRIPTION OF THE PREFERRED EMBODIMENT

Figure 1B:
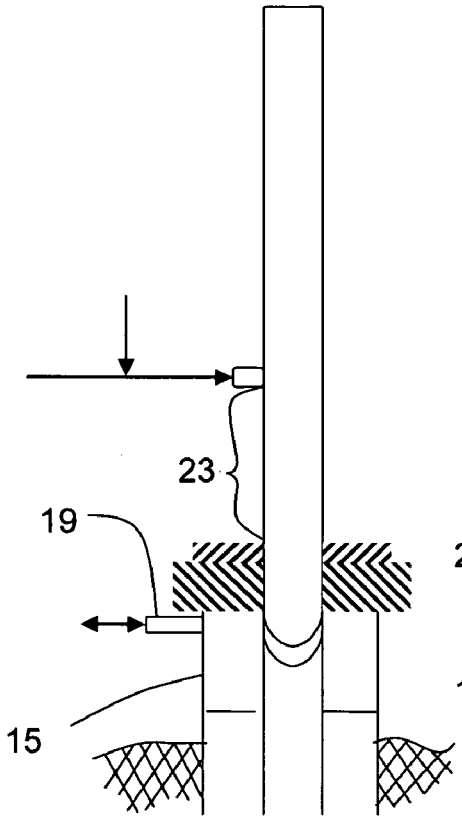
FIG. 1*b* illustrates a partial cross-section of an optional arrangement according to FIG. 1*a* without a lubricator.
Figure 1A:
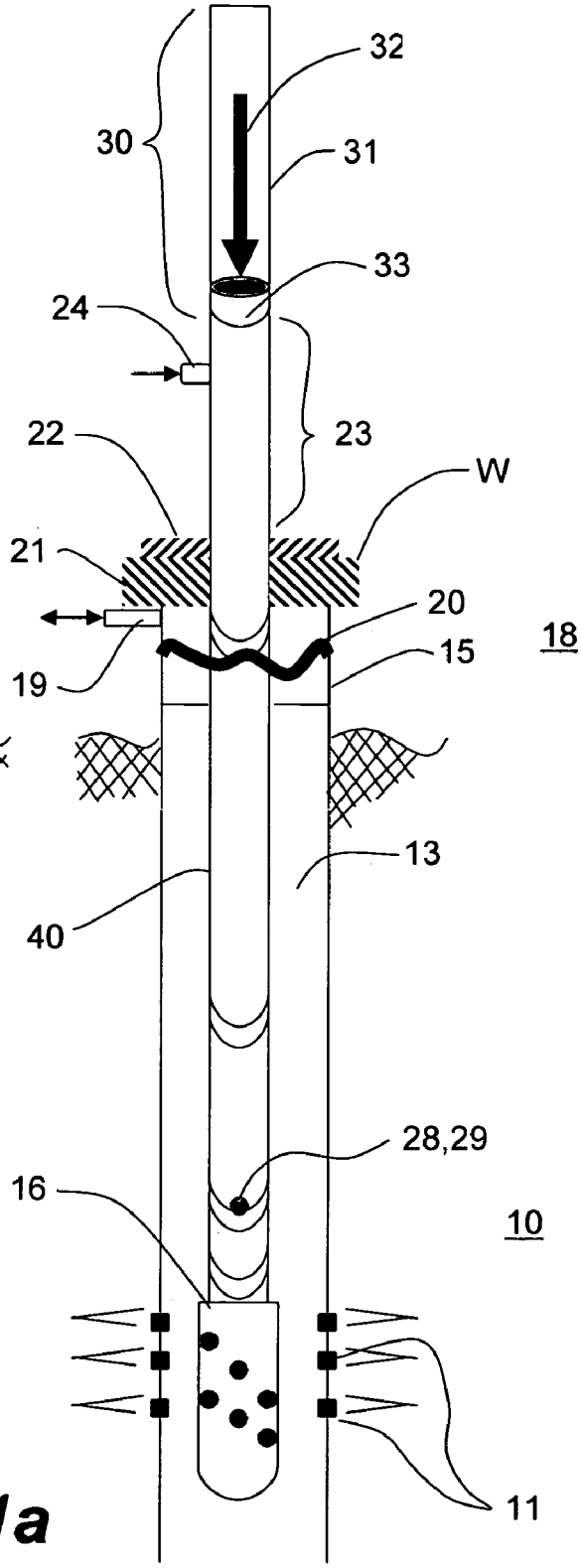
FIG. 1*a* is a simplified cross-section of a wellbore illustrating apparatus run in on a tubing string for placement of propellant carrier adjacent a formation before ignition.

With reference to FIG. 1*a*, in a preferred embodiment of the invention, it is desirable to dislodge blockage mechanisms or debris from the wellbore area of a formerly productive interval of an underground formation 10 adjacent openings in a casing 12 of a wellbore annulus or wellbore 13. Herein, openings are referred to as perforations 11 which are to include other alternate openings enabling communication between the wellbore 13 and formation through the casing 12 including screens, and slots for example. Generally, debris is removed by igniting a propellant 16 in the wellbore 13 and then substantially immediately commencing to inject and circulate low density foam to the surface 18 for the removal of resulting debris.

The formation 10 and wellbore 13, which is no longer producing desired or even commercial rates, is prepared for a workover treatment using an embodiment of the present invention. A suitable wellhead configuration comprises a spool 15 having a foam and debris outlet 19 providing communication with the wellbore 13, a blow-out preventor 21 and a pack-off 22 at a wellhead W, and a pup length of tubing 23 with a foam injection inlet 24.

In one embodiment, propellant 16 is ignited with the assistance of a lubricator 30 further comprising lubricator tubing 31, a drop bar 32 and a trigger 33 such as a mechanical release mechanism or valve for temporarily retaining and releasing the drop bar 32 on command. Alternatively, the propellant 16 may be pressure actuated, both embodiments being described in greater detail below.

With reference also to FIGS. 3*a*–3*h* and FIGS. 4*a*–4*c*, a candidate well is selected 100 (FIG. 4*a*) and a workover string is prepared comprising a tubing string 40 fit at its distal end with a propellant carrier 26 having a firing head (not shown) and a foam injection means 28 such as a foam discharge port 29 in the tubing string 40 adjacent to and uphole of the propellant carrier 26. The tubing string 40 is made up with conventional components to assist in establishing a tubing tally and the like.

Figures 3A, 3B, 3C, 3D, 3E, 3F, 3G, 3H:
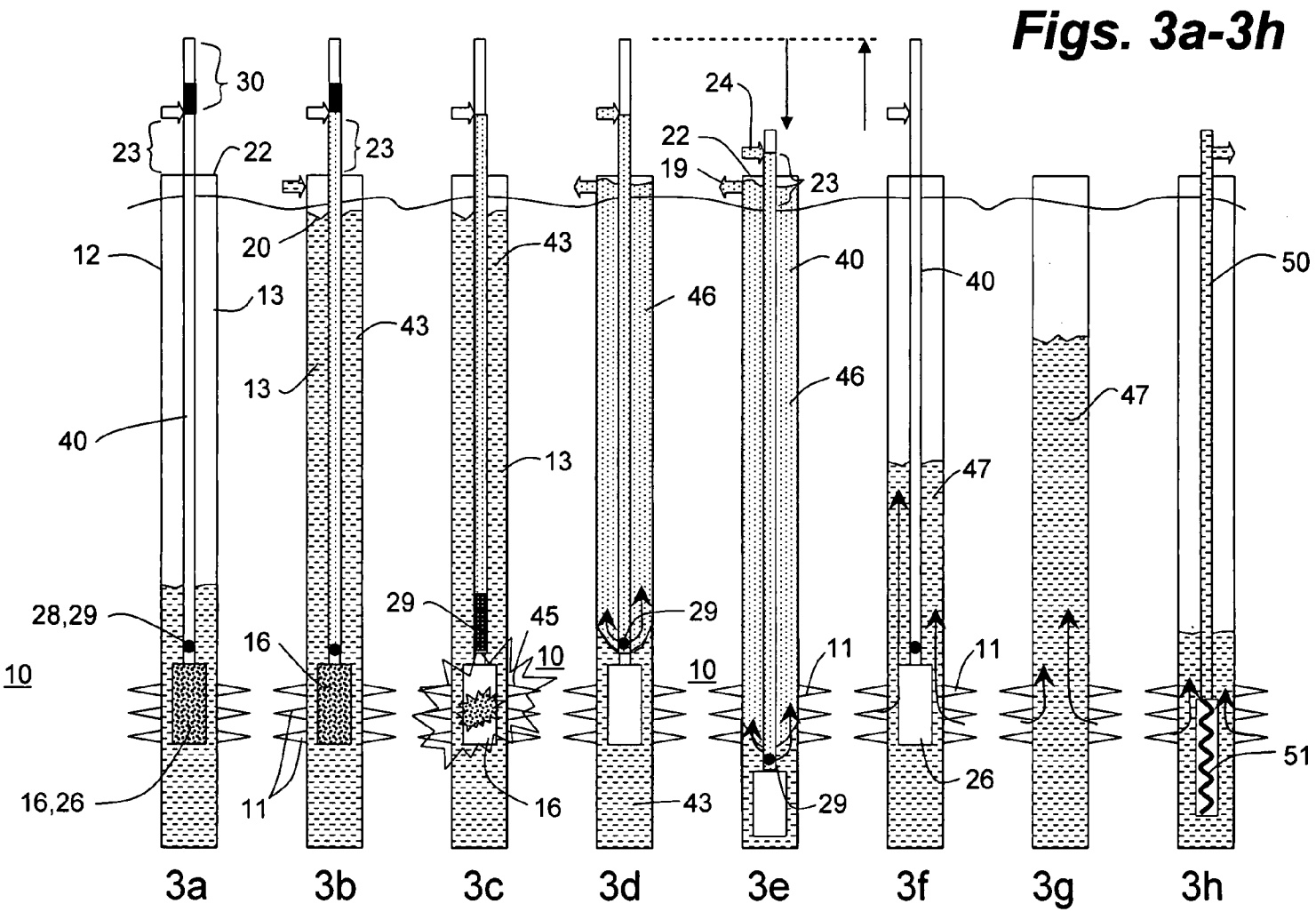
FIGS. 3*a*–3*h* are a series of schematics of a sequence of events according to one embodiment of the invention.
Figure 4A:
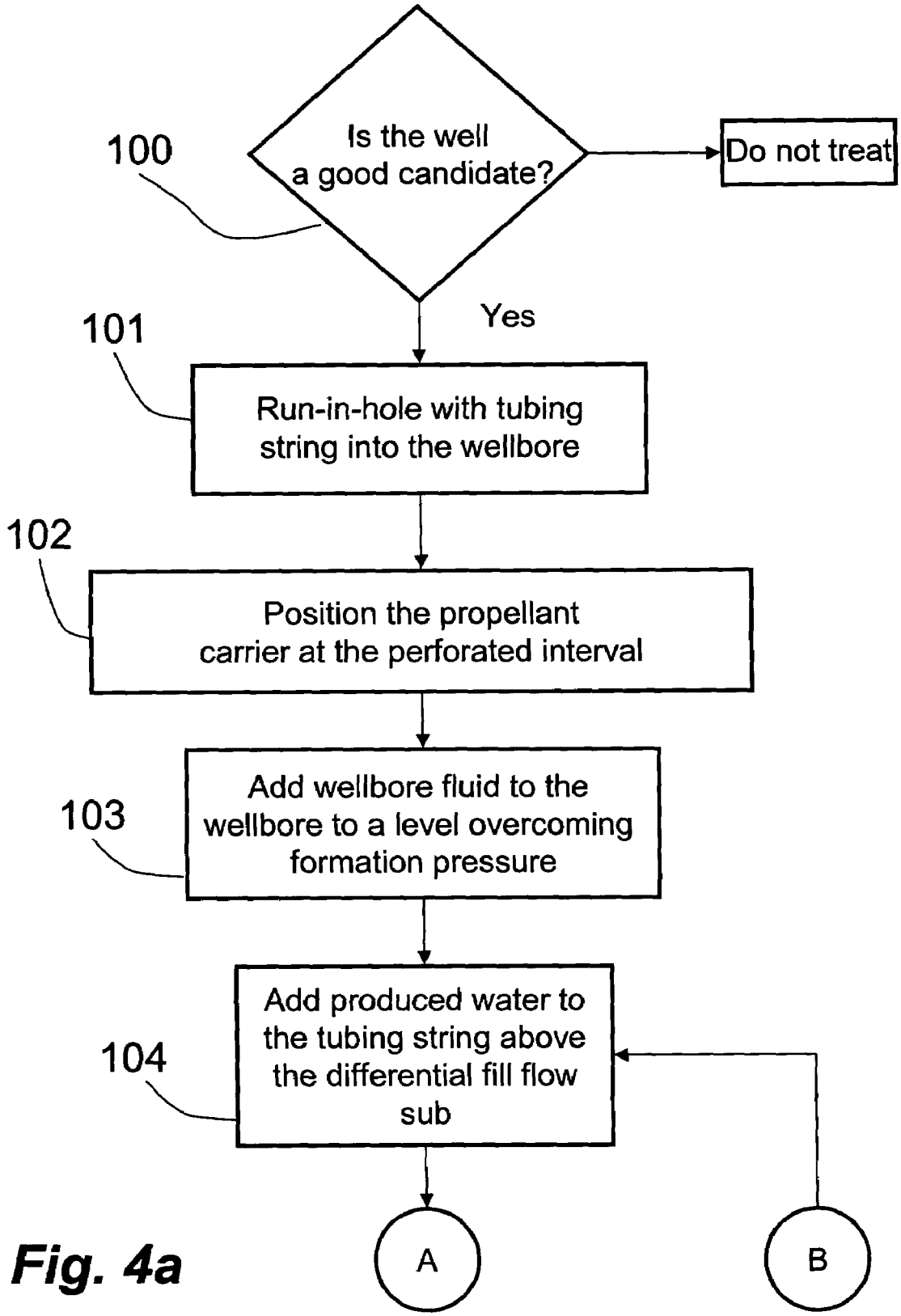
FIG. 4*a*–*c* are sequential flowcharts of some steps of an embodiment of the invention according to FIGS. 3*a*–*h*.

As shown at FIGS. 3*a*,4*a* and at 101, the tubing string 40 is lowered into wellbore 13 such that at 103 the propellant carrier 26 is located across from the existing perforations 11 communicating with the formation 10 to be treated. Of course, safe procedures must be used in a workover including proper tubing string entry techniques. The tubing string 40 is suspended in the wellbore 13 at the packoff 22, the pup length of tubing 23 is installed, having sufficient length to manipulate the tubing string 40 from above the perforations to below the perforations. A lubricator 30 can be installed. The foam injection means 28 can further comprise a differential fill flow sub (not detailed), employed at the bottom of the tubing string 40 to exclude debris and the like during running in.

In FIGS. 3*b*,4*a* and at 104, In no particular order a conventional wellbore liquid 43 is rapidly added to the wellbore 13 for increasing a fluid level 20 and resulting hydrostatic head to about maximum, sufficiently above the perforations 11 or productive interval, maximizing the head which tends to place the well in an overbalanced condition. Also the tubing string 40 is filled with liquid, such as produced water, above the differential fill flow sub. At FIGS. 3*c*,4*a*, the propellant 16 is ignited and the foam discharge port 29 is opened, as described in process step 105. The head of liquid in the tubing string 40 assists in directing the resulting high pressure event into the formation 10 rather than permitting the energy to escape uphole along the tubing string.

Figure 2B:
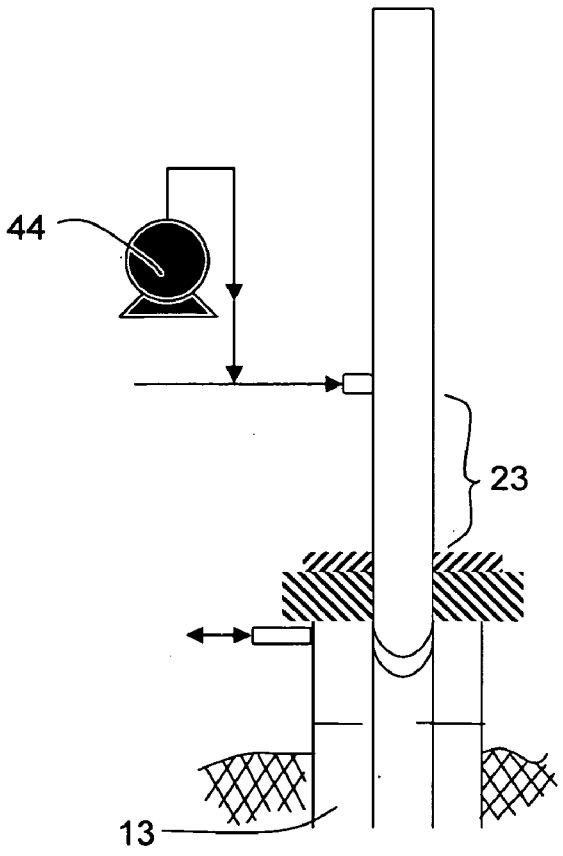
FIG. 2*b* illustrates a partial cross-section of an optional arrangement according to FIG. 2*b* for actuating ignition and foam circulation using pressure-actuation.
Figure 2A:
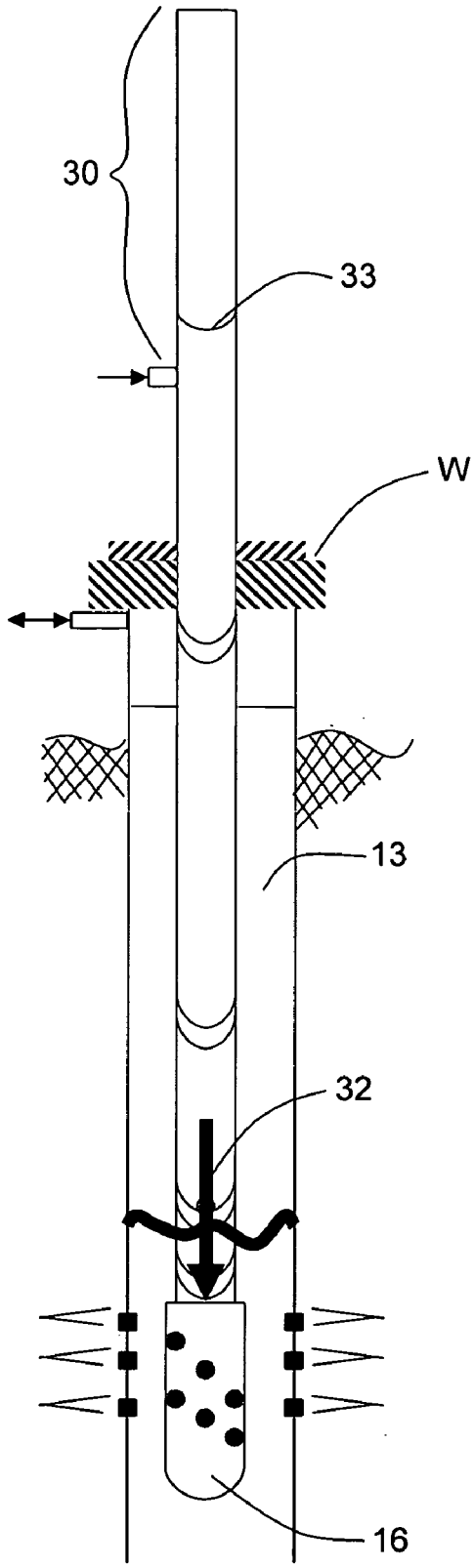
FIG. 2*a* is a simplified cross-section of a wellbore illustrating actuation of the tubing string for ignition and foam circulation.
Figure 4B:
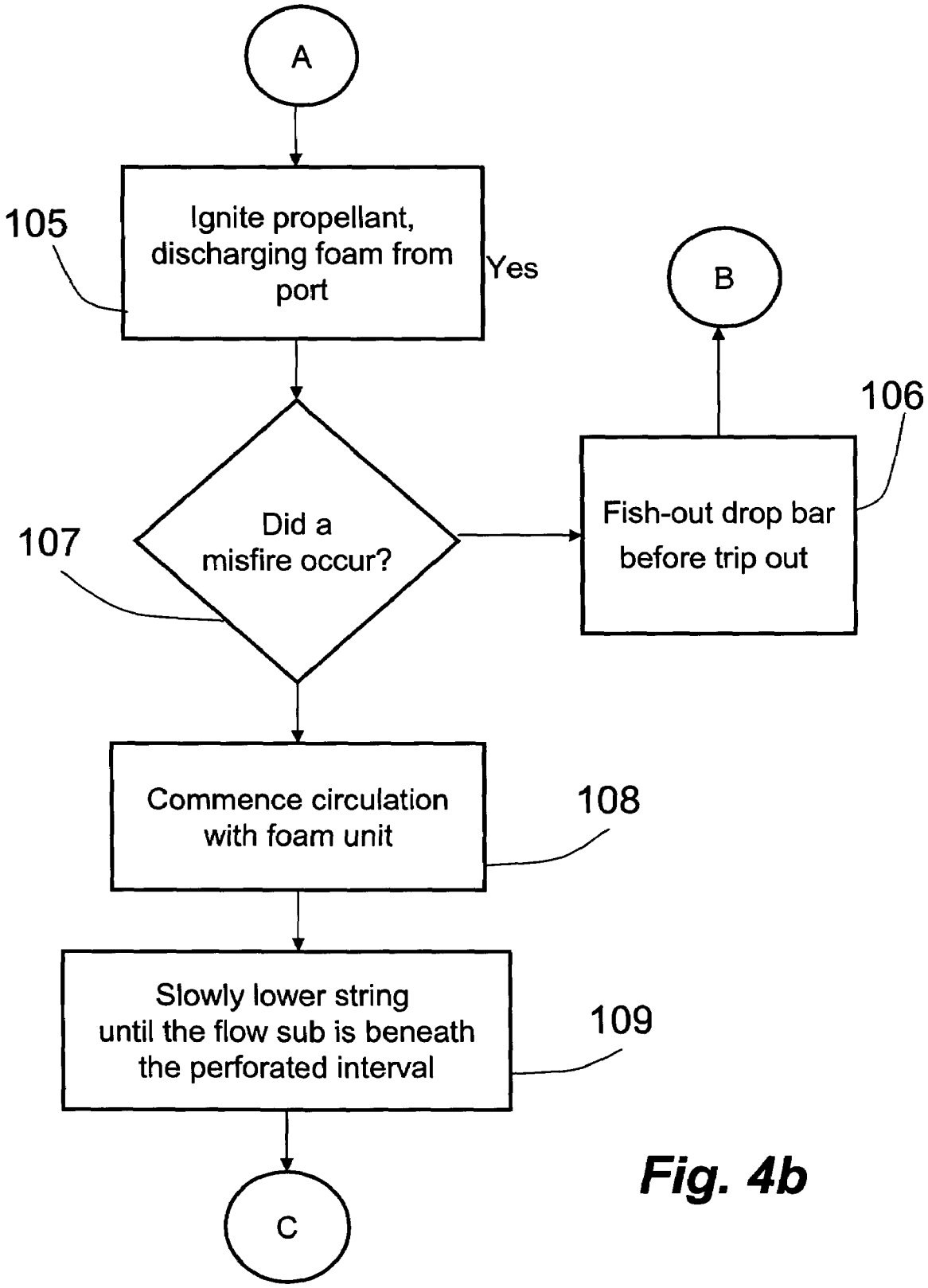

As shown in FIG. 1*a*, in one embodiment the lubricator 30 temporarily houses the drop bar 32 and is used to cooperate with the firing head to initiate ignition of the propellant 16. The fill sub remains sealed from the wellbore 13, excluding liquids therefrom, until actuated by the falling drop bar 32. As shown in FIG. 2*a*, in the context of a lubricator 30, the trigger 33 is actuated for releasing the drop bar 32. The drop bar 32 actuates a firing head which ignites the propellant 16. In FIG. 4*b* and at 105 and 106, should a misfire occur, the drop bar 32 is fished out and re-set to repeat at 104. As well as igniting the propellant 16, the drop bar 32 also actuates the fill sub for opening the foam discharge port 29. In an alternate embodiment, the firing head is pressure actuated. Accordingly, there is no need for a drop bar nor a lubricator. Additionally, the foam injection means 28 comprises the foam discharge port 29 fit with a pressure-actuated plug. In FIG. 2*b*, in the context of a pressure-actuated firing head, a pump 44 is employed to pressurize the tubing string 40 to a first pressure for initiating a pressure-actuated firing head. Unless the pressure-actuated plug is already opened due to the propellant ignition, further pumping is applied and pressure increase releases the pressure-actuated plug at the foam discharge port 29 enabling communication with the wellbore 13.

In FIGS. 3*c*,4*a*, and at 104, hydrostatic pressure of the liquid 43 in the wellbore 13 as well as that of the liquid in the tubing 40 assists in directing the resulting high pressure event into the formation 10 rather than wasting the energy uphole. Rapidly expanding gas and pressure 45 assists in removing blockages from the formation 10 about the perforations 11.

At FIGS. 3*d*,4*b* and at 107 and substantially immediately after igniting the propellant 16, conventional low density foam 46 is injected into the wellbore 13 through the foam discharge port 29. The circulation of foam 46 is established through the injection inlet 24 at the pup length of tubing 23 at surface and wellbore liquid 43 and foam 46 are recovered from the wellbore 13 through the spool 15 at surface. The foam 46 dramatically lowers the hydrostatic head on the formation 10 stimulating production of formation fluids. The wellbore 13 is now exposed to larger formation pressure and inflow. As a result, debris is produced into the wellbore 13. Additionally, circulation of the foam 46 and its relatively high viscosity aid in conveying the produced debris up the wellbore 13 to the surface. The foam 46 is circulated and transports wellbore liquid 43 and debris to the surface 18 where it is removed with the foam 46. Circulation of foam 46 ensures the capture and removal of substantially all produced debris, as the low density foam 46 rises to the surface 18.

Figure 4C:
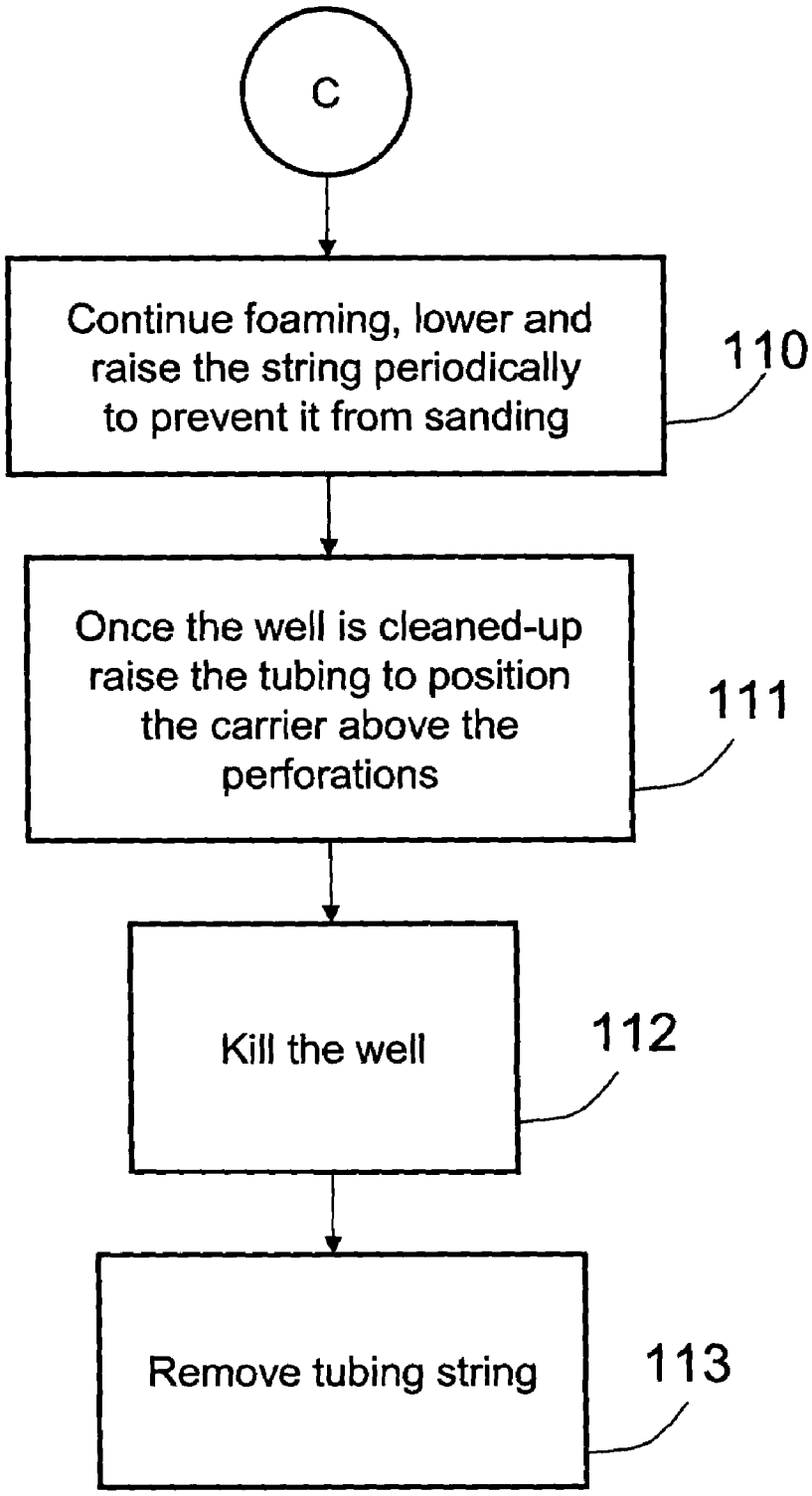

At FIGS. 3*e*,4*b* and at 108, when circulating foam 46 and for more effective removal of debris, the tubing string 40 is slowly lowered so that foam discharge port 29 is below the perforations 11. The ability to lower the tubing string 40 and the depth it can be lowered is predetermined by the pup length of tubing 23 above the packoff seal 22. In FIG. 4*c* and at 109, it can be desirable in some instances to stroke, or lower and raise, the tubing string 40 periodically to prevent lodging of the debris and sand flowing into the wellbore 13 between the tubing string 40 and well casing 12. This action is recommended to continue until sufficient debris has been successfully removed.

At FIGS. 3*f*,4*c* once sufficient debris has been removed, the formation 10 is sufficiently rejuvenated so as to re-establish useful inflow. At 110, the tubing string 40 then raised to elevate the propellant carrier 26 above the perforations 11 and, at 111, one of a variety of techniques can be used to apply sufficient hydrostatic head to kill the well before safely pulling the tubing string 40 from the wellbore 13 at FIGS. 3*g*,4*c*. Typically the methodology for killing the well is tailored to the particular well and can include simply diminishing foam circulation or circulating air to allow formation fluid 47 production to fill the annulus 13 and kill the well or more aggressively to load up with a suitable wellbore liquid 43.

At FIGS. 3*h*,4*c*, and as an objective of rehabilitating the formation 10, a production string 50 with pump 51 can be run in to re-establish production from the treated well.

Note that propellant carriers and foam formulations are known and include those set forth in Jennings Jr. U.S. Pat. No. 4,617,997.

As suggested in FIG. 4*a* at 100, some wells are better candidates than others for this process, and while this process was developed for the criteria described below, is not limited to these applications:

- The well would have a shut-in fluid level, or low cumulative production, to indicate some recoverable reserves are still in place;
- The well would have exhibited a dramatic, or catastrophic, decline in production, indicating a blockage mechanism has occurred and the decline rate is not natural depletion;
- Offset wells where previous re-perforating, and propellant stimulation operation has provided incremental production, even briefly, where the increased production may sustain due to the increased depth of stimulation from the propellant or removal of the debris by the stable foam operation;
- Wells with diagnosed shale collapse are excellent candidates due to suspicion of the presence of large particulate debris and suspicions that such deposits are a distance from the wellbore; and
- This method is further recommended in cases where less aggressive work over techniques have failed, or have failed to sustain increased production.

The embodiments of the invention in which an exclusive property or privilege is being claimed are detailed as follows:

1. A process for treating a wellbore having openings in communication with a damaged formation comprising:

running in a tubing string into the wellbore to position a propellant carrier adjacent the openings;

overbalancing the wellbore with liquid to establish hydrostatic pressure on the formation;

igniting the propellant so as to produce a pressure event and a volume of gas directed into the formation;

substantially immediately after igniting the propellant injecting low density foam from the tubing string and into the wellbore through a port in the tubing string above the propellant carrier so as to reduce the hydrostatic pressure and produce at least some debris from the formation and into the wellbore; and conveying the debris from the wellbore by circulating the foam out of the wellbore to at surface until sufficient debris is removed.

2. The process for treating a wellbore of claim 1 wherein overbalancing the wellbore further comprises filling the tubing with liquid.

3. The process of claim 1 wherein the injecting of foam step further comprises lowering the port for injecting the foam from a location above the openings to a location below the openings after the substantially immediate injection.

4. The process of claim 3 wherein the injecting of foam step further comprises continuously injecting foam while lowering the location of injecting the foam.

5. The process of claim 3 wherein the injecting of foam step further comprises stroking the tubing string to periodically alternate the location of injection of the foam from below the openings to above and returning to below the openings.

6. The process of claim 1 where the propellant ignition step further comprises:

providing a lubricator having a drop bar and a trigger; and triggering release of the drop bar to fall through the tubing string to the propellant carrier for actuating ignition of the propellant.

7. The process of claim 6 wherein the injecting of foam step further comprises opening the port in the tubing string by the falling drop bar.

8. The process of claim 7 wherein the injecting of foam step further comprises lowering the port from a location above the openings to a location below the openings.

9. The process of claim 8 wherein the injecting of foam step further comprises continuously injecting foam while lowering the location of injecting the foam.

10. The process of claim 7 wherein the injecting of foam step further comprises stroking the tubing string to periodically alternate the location of injection of the foam from below the openings to above and returning to below the openings.

11. The process of claim 1 where the propellant ignition step further comprises pumping liquid into the tubing string to a first pressure for actuating a pressure actuated firing head for actuating ignition of the propellant.

12. The process of claim 11 wherein the injecting of foam step further comprises pumping liquid into the tubing string to a second pressure for actuating a pressure-actuated plug to open the port in the tubing string.

13. The process of claim 1 further comprising killing the wellbore and removing the tubing string.

14. A process for treating a wellbore perforated into a formation comprising:

placing a tubing string into the wellbore having at its distal end, a propellant carrier containing propellant; and means for injecting foam from the tubing string above the propellant carrier and into the wellbore;

positioning the propellant carrier adjacent the openings;

overbalancing the wellbore;

igniting the propellant so as to produce a volume of gas sufficient to dislodge debris in the formation;

substantially immediately after igniting the propellant injecting low density foam into the wellbore adjacent the openings using foam injecting means; and circulating the foam into and out of the wellbore for removing debris out of the wellbore.

15. The process of claim 14 further comprising killing the wellbore and removing the tubing string.

16. The process of claim 14 wherein the means for injecting foam comprises a port in the tubing string.

17. The process of claim 16 further comprising lowering the port to a location below the openings immediately after the foam injection is substantially immediately injected.

18. The process of claim 17 further comprising the raising and lowering of the tubing string periodically while circulating foam so as to prevent a blockage of debris forming between the tubing and the well casing.

19. The process of claim 18 further comprising raising the port above the openings once an acceptable rate of production from the formation is achieved.

20. Apparatus for treating a wellbore having an opening in the casing which are in communication with a damaged formation comprising:

a tubing string in the casing and extending downhole from surface for positioning a propellant in a propellant carrier adjacent the openings and forming an annulus between the tubing string and the casing;

means for igniting the propellant; and means for injecting foam from the tubing string at an injection location adjacent the openings and above the propellant carrier substantially immediately after the propellant is ignited, and circulating the foam up the annulus and out of the wellbore.

21. The apparatus of claim 20 further comprising:

a pup length of tubing at the top of the tubing string;

a seal between the wellbore and the pup length of tubing; and means for raising and lowering the pup length of tubing and the tubing string so as to move the injection location between a location above the openings to a location below the openings.

22. The apparatus of claim 20 where the means for igniting the propellant comprises:

a lubricator at surface atop the tubing string and having a drop bar releasably retained therein; and a firing head at the propellant carrier and actuable to ignite the propellant when the drop bar is released to fall down the tubing string to the propellant carrier.

23. The apparatus of claim 22 where the lubricator further comprises a trigger so as to release the drop bar.

24. The apparatus of claim 20 where the means for circulating foam comprises:

a foam injection inlet in the tubing string at surface;

a port in the tubing string adjacent and above the propellant carrier, and a foam discharge port from the annulus at surface.

25. The apparatus of claim 24 wherein the port further comprises a differential fill flow sub for blocking communication between the tubing string and the annulus until circulating foam.

26. The apparatus of claim 24 wherein the means for igniting the propellant comprises a lubricator at surface atop the tubing string and having a drop bar releasably retained therein; and a firing head at the propellant carrier and actuable to ignite the propellant when the drop bar is released to fall down the tubing string to the propellant carrier;

the lubricator further comprises a trigger so as to release the drop bar; and the port further comprises a differential fill flow sub for blocking communication between the tubing string and the annulus and actuable with the drop bar for circulating foam.

* * * * *